US011335986B2

(12) United States Patent
Hamada et al.

(10) Patent No.: US 11,335,986 B2
(45) Date of Patent: May 17, 2022

(54) HIGH-FREQUENCY CONNECTION INCLUDING AN INDUCTANCE ADJUSTMENT BLOCK BETWEEN A TRANSMISSION LINE AND A WAVEGUIDE

(71) Applicant: Nippon Telegraph and Telephone Corporation, Tokyo (JP)

(72) Inventors: Hiroshi Hamada, Tokyo (JP); Teruo Jo, Tokyo (JP); Hideyuki Nosaka, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 16/979,927

(22) PCT Filed: Feb. 22, 2019

(86) PCT No.: PCT/JP2019/006769
§ 371 (c)(1),
(2) Date: Sep. 11, 2020

(87) PCT Pub. No.: WO2019/181361
PCT Pub. Date: Sep. 26, 2019

(65) Prior Publication Data

US 2021/0013576 A1 Jan. 14, 2021

(30) Foreign Application Priority Data

Mar. 19, 2018 (JP) ..... JP2018-050707

(51) Int. Cl.
*H01P 5/107* (2006.01)
*H01P 1/16* (2006.01)
(Continued)

(52) U.S. Cl.
CPC ..... *H01P 5/107* (2013.01); *H01P 1/16* (2013.01); *H01P 3/12* (2013.01); *H01P 5/02* (2013.01)

(58) Field of Classification Search
CPC ..... H01P 5/107
(Continued)

(56) References Cited

U.S. PATENT DOCUMENTS

| | | | | |
|---|---|---|---|---|
| 5,969,580 | A | 10/1999 | Maillet et al. | |
| 2009/0066441 | A1* | 3/2009 | Woods et al. | H01P 5/107 333/34 |
| 2009/0219107 | A1* | 9/2009 | Woods et al. | H01P 5/107 333/32 |

FOREIGN PATENT DOCUMENTS

| | | | |
|---|---|---|---|
| JP | H10126116 | A | 5/1998 |
| JP | 2015046741 | A | 3/2015 |

OTHER PUBLICATIONS

Deal, William, et al., "THz Monolithic Integrated Circuits Using InP High Electron Mobility Transistors," IEEE Transactions on Terahertz Science and Technology, vol. 1, No. 1, Sep. 2011, 8 pages.

* cited by examiner

*Primary Examiner* — Benny T Lee
(74) *Attorney, Agent, or Firm* — Slater Matsil, LLP

(57) ABSTRACT

A high frequency connection structure includes: a waveguide; a ridge coupler constituted by a conductor formed inside one end of the waveguide; a transmission line adjacent to the one end of the waveguide; an inductance adjustment structure which is provided between the ridge coupler and the transmission line and which adjusts ground inductance that is created due to a connection between the ridge coupler and the waveguide; and a wire which connects one end of the ridge coupler on a side of the transmission line and one end of the transmission line with each other.

13 Claims, 13 Drawing Sheets

(51) Int. Cl.
*H01P 3/12* (2006.01)
*H01P 5/02* (2006.01)

(58) Field of Classification Search
USPC ..... 333/26
See application file for complete search history.

PRIOR ART

PRIOR ART

PRIOR ART

PRIOR ART

HIGH-FREQUENCY CONNECTION INCLUDING AN INDUCTANCE ADJUSTMENT BLOCK BETWEEN A TRANSMISSION LINE AND A WAVEGUIDE

CROSS-REFERENCE TO RELATED APPLICATIONS

This application is a national phase entry of PCT Application No. PCT/JP2019/006769, filed on Feb. 22, 2019, which claims priority to Japanese Application No. 2018-050707, filed on Mar. 19, 2018, which applications are hereby incorporated herein by reference.

TECHNICAL FIELD

The present invention relates to a high frequency connection structure and, particularly, to a mode conversion technique between a high frequency circuit and a waveguide conversion unit.

BACKGROUND

A high frequency circuit using a frequency band of 100 GHz or higher is normally packaged so as to use a waveguide as an interface. An important technique for the packaging is a low-loss connection technique between the high frequency circuit and the waveguide. As conventional low-loss connection techniques, high frequency connection structures using a dipole-type coupler (hereinafter, referred to as a "dipole coupler") disclosed in NPL1 or a ridge-type coupler (hereinafter, referred to as a "ridge coupler") disclosed in PTL1 have been reported.

For example, the dipole coupler described in NPL1 forms metal wiring that resembles a dipole antenna at an end of a high frequency circuit formed on a semiconductor such as InP or silica or dielectric substrate. In addition, by inserting the metal wiring in an E-plane of a waveguide, a connection between the high frequency circuit and the waveguide is realized with low loss.

The high frequency connection technique described in NPL1 utilizes the fact that an electric field formed in a vicinity of a dipole coupler and an electric field which is formed on an E-plane of a TE10 mode and which propagates through the waveguide have similar mode shapes.

With the dipole coupler described in NPL1, while wideband characteristics are obtained, since the dipole coupler is formed on a semiconductor or dielectric substrate, dielectric loss of the substrate is inevitable. In addition, since there is also an effect of increasing conduction loss of the dipole due to an electric field concentration effect caused by a wavelength shortening effect of the semiconductor or dielectric, connection loss slightly increases.

On the other hand, for example, the high frequency connection structure using a ridge coupler described in PTL1 uses a ridge coupler constituted by a metal block which is machined in a tapered shape and which is arranged along a center of an H-plane of the waveguide. A mode of electromagnetic waves that propagate through the waveguide is gradually converted by such a metal block into a propagation mode of electromagnetic waves that propagate over a high frequency circuit such as a coplanar line or a microstrip line. Accordingly, the high frequency circuit and the waveguide are connected with low loss.

Since the ridge coupler described in PTL1 does not use a semiconductor or dielectric substrate as in the case of a dipole coupler, dielectric loss of a substrate and a conduction loss increasing effect of the dipole due to an electric field concentration effect caused by a wavelength shortening effect of a semiconductor and a dielectric can be avoided. Therefore, a connection between a high frequency circuit and a waveguide with lower loss can be realized by the technique described in PTL1.

A conventional ridge coupler will now be described with reference to FIGS. 9(*a*) and 9(*b*). FIG. 9(*a*) is a schematic plan view of a conventional high frequency connection structure 200 using a ridge coupler 212. In addition, FIG. 9(*b*) is a sectional view taken along line A-A' in FIG. 9(*a*).

The conventional high frequency connection structure 200 of FIGS. 9(*a*) and 9(*b*) using the ridge coupler 212 connects a waveguide 210 provided with the ridge coupler 212 with a high frequency circuit 221. A grounding post 222, a transmission line 223, and the like are arranged on a high frequency substrate 220. An end of the ridge coupler 212 on a side of the high frequency substrate 220 and an end of the transmission line 223 of the high frequency substrate 220 are connected by a wire 230. The high frequency connection structure 200 includes a waveguide wall surface 211.

As shown in FIG. 9, the conventional high frequency connection structure 200 differs from other conventional high frequency connection structures such as a dipole coupler in that the ridge coupler 212 is galvanically connected to the waveguide 210.

Normally, since the waveguide 210 is constituted by a highly-conductive metal and a volume thereof is sufficiently larger than the high frequency circuit 221, free electrons are present in abundance. For this reason, the waveguide 210 acts as an ideal ground from the perspective of the high frequency circuit 221. Therefore, a ground inductance L shown in FIG. 10 appears to be equivalently present in the ridge coupler 212 to be connected between the waveguide 210 and the high frequency substrate 220.

A designer need not be aware of the ground inductance L as long as the ridge coupler is used within an operating band. During mode conversion, by a mode converting unit, from the waveguide 210 (waveguide mode (TE10 Mode) to the transmission line 223 (or a high frequency pad; transmission line mode (TEM mode)) on the high frequency circuit 221, an electric field is converted into a microstrip mode in which an upper part of the ridge coupler 212 is a signal line and a waveguide wall surface 211 is ground as shown in FIG. 11. Therefore, the ground inductance L becomes unviewable in the microstrip mode.

However, as shown in FIG. 12, electromagnetic waves can no longer propagate (cutoff) through the waveguide 210 outside an operating band of the ridge coupler 212 or outside an operating band of the waveguide 210. More specifically, since the waveguide 210 has bypassing characteristics, electromagnetic waves cannot propagate through the waveguide 210 at a frequency band equal to or lower than a cutoff frequency of the waveguide 210. Therefore, from the perspective of a side of the high frequency circuit 221, a side of the waveguide 210 with respect to the ridge coupler 212 ends up acting as a reflecting wall.

A reflecting point in that case is not a connecting point between the high frequency circuit 221 (in transmission line mode (TEM mode)) and the ridge coupler 212 but, instead, a connecting point between the ridge coupler 212 and ground (a waveguide wall surface 211) via the ground inductance L. This is the reason that the ridge coupler 212 has the ground inductance L in a low frequency band as described with reference to FIG. 10.

The ground inductance L only acts outside the operating band of the ridge coupler 212. Therefore, in a case where the ridge coupler 212 is connected to the high frequency circuit 221 which prevents signals outside the operating band of the ridge coupler 212 from being input to or output from the ridge coupler 212, there is no effect on circuit operations. For example, no problems arise when connecting an amplifier that operates within the operating band of the ridge coupler 212 to the ridge coupler 212.

However, when connecting a circuit including a low-frequency signal such as a mixer or a frequency multiplier to the ridge coupler 212, circuit characteristics deteriorate significantly due to the ground inductance L.

For example, as shown in FIG. 13, a case where the ridge coupler is applied to a high frequency circuit of a mixer such as a drain implantation mixer or a resistive mixer using a source (S)-grounding FET will be considered.

An IF signal shares a drain (D) terminal of the FET with an RF signal or a LO signal. The IF signal (through the IF terminal) is connected to the drain terminal of the FET via an IF matching circuit, and the RF/LO signal is connected to the drain via a RF/LO matching circuit. Further an additional RF signal or an additional LO signal may also be connected to a gate (G) of the FET via an additional LO/RF matching circuit. Therefore, from the IF signal, the ridge coupler for the RF signal or the LO signal is directly visible via the drain terminal of the FET.

Normally, since a desired band of the IF signal is equal to or lower than a cutoff frequency of a waveguide, the ground inductance L of the ridge coupler 212 is directly visible from the IF signal and directly affects characteristics of the mixer. Specifically, since the IF signal is a low-frequency signal, the IF signal in a band ranging from direct current to low frequency is grounded via the ground inductance L and, as a result, voltage swing hardly occurs at the IF terminal and conversion gain of the mixer decreases significantly.

CITATION LIST

Patent Literature

PTL1 Japanese Patent Application Laid-open No. 2015-46741, published on Mar. 12, 2015.

Non Patent Literature

NPL1 Deal, William, et al. "THz monolithic integrated circuits using InP high electron mobility transistors". IEEE Transactions on Terahertz Science and Technology 1.1 (2011): 25-32.

SUMMARY OF THE INVENTION

Technical Problem

In conventional high frequency connection structures, when applying a ridge coupler to a high frequency circuit that handles signals outside an operating band of a waveguide or the ridge coupler, characteristic degradation of the high frequency circuit due to ground inductance of the ridge coupler poses a major problem.

Embodiments of the present invention have been made in order to solve the problem described above and an object thereof is to provide a high frequency connection structure capable of suppressing characteristic degradation of a high frequency circuit due to ground inductance of a ridge coupler.

Means for Solving the Problem

In order to solve the problem described above, a high frequency connection structure according to embodiments of the present invention includes: a waveguide; a ridge structure constituted by a conductor formed inside one end of the waveguide; a transmission line adjacent to the one end of the waveguide; an inductance adjustment structure which is provided between the ridge structure and the transmission line and which adjusts ground inductance that is created due to a connection between the ridge structure and the waveguide; and a wire which connects one end of the ridge structure on a side of the transmission line and one end of the transmission line with each other.

In addition, the high frequency connection structure according to embodiments of the present invention may further include a base having a side surface which is parallel to a side surface of the ridge structure, wherein the ridge structure is formed in a truncated square pyramid shape and angles formed between a side surface on a side of the transmission line and a bottom surface and a top surface are, respectively, right angles, the bottom surface of the ridge structure is in contact with an inner wall of the waveguide, the transmission line is formed on an integrated circuit board, the integrated circuit board is supported by the base, and the wire connects one end of the top surface of the ridge structure and one end of the transmission line with each other.

Furthermore, in the high frequency connection structure according to embodiments of the present invention, the inductance adjusting structure may include a metal block formed in a rectangular parallelepiped that is respectively in contact with the side surface of the ridge structure, the side surface of the base, and the inner wall of the waveguide.

In addition, in the high frequency connection structure according to embodiments of the present invention, a height of the metal block in a direction perpendicular to a propagation direction of electromagnetic waves in the waveguide may be lower than a height from the inner wall of the waveguide to the wire.

Furthermore, in the high frequency connection structure according to embodiments of the present invention, the inductance adjusting structure may be a depressed portion formed on the inner wall of the waveguide on a side of the bottom surface of the ridge structure from an end on a side of the side surface of the ridge structure to the side surface of the base.

In addition, in the high frequency connection structure according to the present invention, a length of the depressed portion in the propagation direction of electromagnetic waves in the waveguide may be longer than a distance between the side surface of the ridge structure and the side surface of the base.

Effects of Embodiments of the Invention

According to embodiments of the present invention, even when applying a ridge coupler to a high frequency circuit that handles signals outside an operating band of a waveguide or the ridge coupler, characteristic degradation of the high frequency circuit due to ground inductance of the ridge coupler can be suppressed.

DETAILED DESCRIPTION OF ILLUSTRATIVE EMBODIMENTS

Hereinafter, preferred embodiments of the present invention will be described in detail with reference to FIGS. 1, 2(*a*), 2(*b*), 3, 4, 5, 6(*a*), 6(*b*), 7, 8, 9(*a*), 9(*b*), 10, 11, 12, and 13.

Principle of Embodiments of the Invention

First, a principle of a high frequency connection structure using a ridge coupler according to an embodiment of the present invention will be described. The high frequency connection structure according to the present embodiment includes an inductance adjustment structure which is formed on a ridge coupler provided in a waveguide and which is means for adjusting a value of a ground inductance L.

In order to eliminate an effect of the ground inductance L from the perspective of a signal equal to or lower than a cutoff frequency of the waveguide (hereinafter, this frequency will be represented by "$f_{IF}$"), an impedance Z from the high frequency circuit to the side of the ridge coupler at $f_{IF}$ may be opened or, in other words, the impedance Z may be set to infinity.

Figure 1:
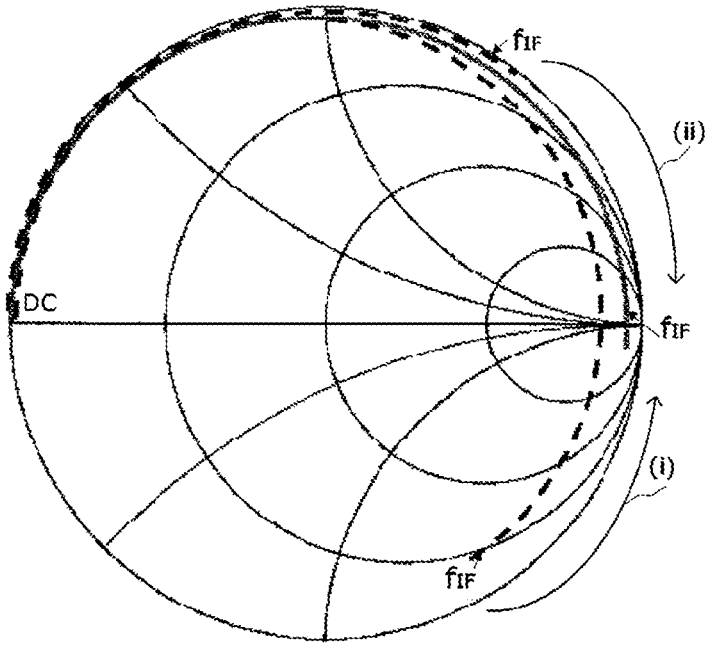
FIG. 1 is a diagram illustrating a principle of ground inductance adjustment according to an embodiment of the present invention.

As shown in the Smith chart in FIG. 1, since the ridge coupler is grounded, a reflection coefficient from the high frequency circuit to the side of the ridge coupler traces a locus that encircles an outer edge portion of the Smith chart in a clockwise direction from a left end (i.e. DC) of the Smith chart as frequency rises as depicted by a dashed line.

In order to eliminate the effect of the ground inductance L in the high frequency connection structure described above, a locus at $f_{IF}$ may be adjustable to a right end of the Smith chart or, in other words, open (impedance Z is infinity).

Figure 10:
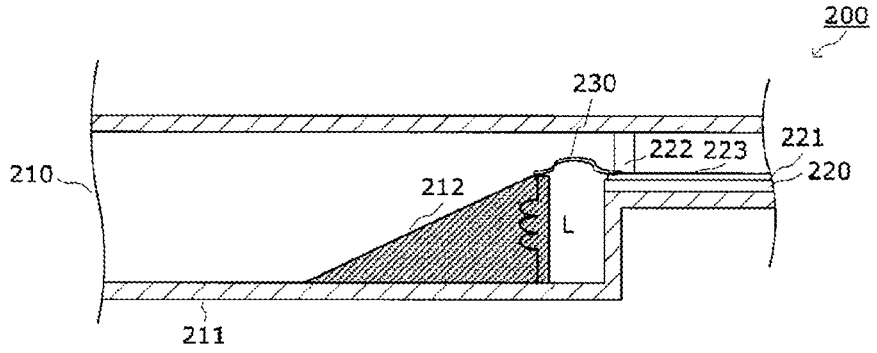
FIG. 10 is a diagram illustrating an equivalent circuit of the conventional high frequency connection structure.

In this case, a value of the ground inductance L described with reference to FIG. 10 is determined by a height of the ridge coupler. More specifically, the height of the ridge coupler is a length from a wall surface of a lower portion of the waveguide to the wire. This height is determined by a diameter of an E-plane of the waveguide and a position of a matching surface of the high frequency circuit and the ridge coupler.

The diameter of the E-plane of the waveguide is determined by standards of the waveguide. On the other hand, the position of the matching surface of the high frequency circuit and the ridge coupler is determined based on requirements on a side of the high frequency circuit such as a thickness of chips in the high frequency circuit. Therefore, it is difficult to adjust the value of the ground inductance L by adjusting the height of the ridge coupler.

In the embodiment according to the present invention, the value of the ground inductance L at $f_{IF}$ is adjusted by providing a structure for adjusting the ground inductance L between the ridge coupler and the transmission line of the high frequency circuit. By providing such a structure for adjusting the ground inductance L, the ground inductance L is reduced and open/matching is performed at $f_{IF}$ as indicated by an arrow (i) in FIG. 1. In addition, open/matching at $f_{IF}$ is performed by increasing the ground inductance L as indicated by an arrow (ii).

First Embodiment

Hereinafter, a high frequency connection structure 1 according to a first embodiment of the present invention will be described in detail. It should be noted that an inductance adjusting structure in a case where ground inductance L is reduced will be described below. This corresponds to a case of performing adjustment in the direction of the arrow (i) as described with reference to the Smith chart in FIG. 1.

Figure 2A:
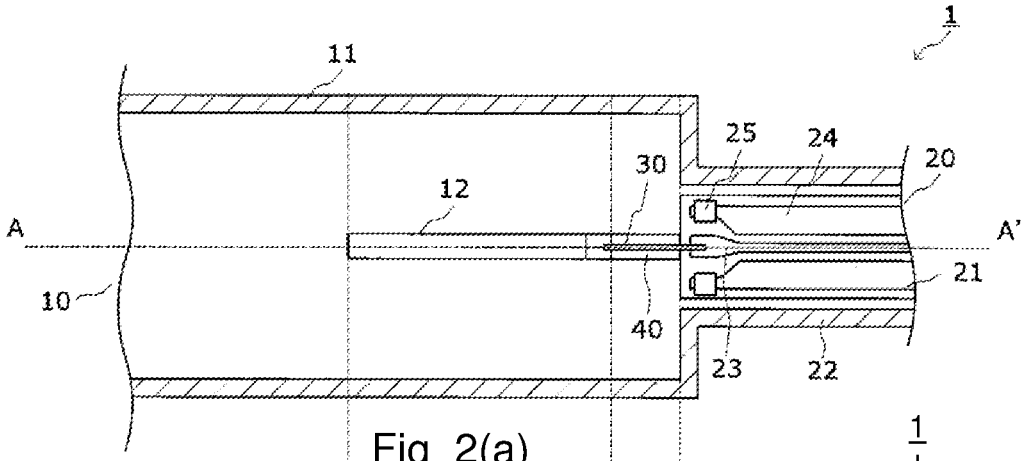
FIGS. 2(*a*) and 2(*b*) are schematic views of a high frequency connection structure according to a first embodiment.
Figure 2B:
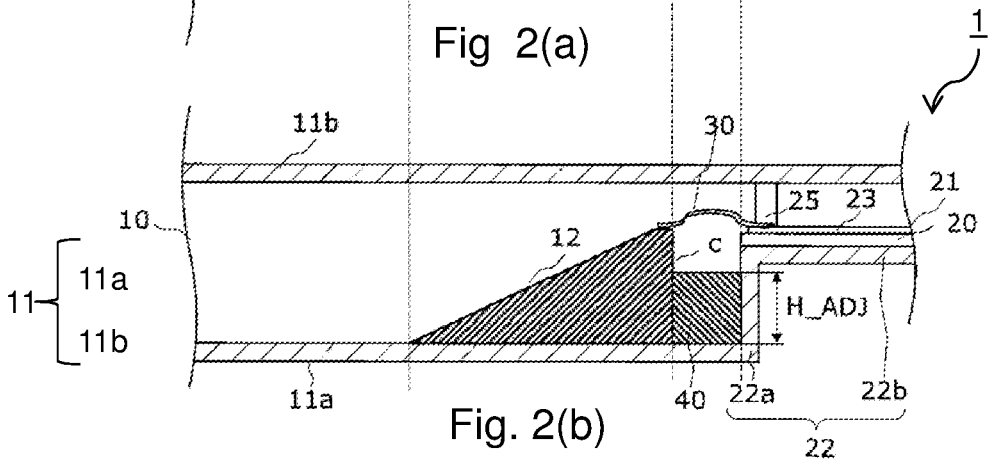

FIG. 2(*a*) is a schematic plan view of the high frequency connection structure 1. FIGS. 2(*b*) and 3 are sectional views taken along line A-A' in FIG. 2(*a*). As shown in FIGS. 2(*a*), 2(*b*), and 3, the high frequency connection structure 1 includes a waveguide 10, a high frequency substrate 20 (an integrated circuit board), a wire 30, and a metal block 40. In the high frequency connection structure 1 according to the present embodiment, the high frequency substrate 20 and the waveguide 10 provided with a ridge coupler (a ridge structure) 12 are connected using the wire 30.

As shown in FIGS. 2(*a*), 2(*b*), and 3, the waveguide 10 includes a waveguide wall 11 (see FIGS. 2(*a*) and 2(*b*)) and the ridge coupler 12. The waveguide wall 11 is constituted by a conductor and forms the waveguide 10 which has, for example, a tubular shape. As shown in FIGS. 2(*b*) and 3, the waveguide wall 11 has a first surface 11*a* and a second surface 11*b* that opposes the first surface 11*a*. The high frequency substrate 20 is arranged inside a space formed between the first surface 11*a* and the second surface 11*b* of the waveguide wall 11 so as to be adjacent to the waveguide 10.

The ridge coupler 12 is formed inside one end of the waveguide 10. More specifically, as shown in FIGS. 2(*b*) and 3, the ridge coupler 12 is provided in contact with the first surface 11*a* which is an inner wall of the waveguide 10 in a sectional view and provided inside a space of the waveguide 10 which is formed between the first surface 11*a* and the second surface 11*b*.

The ridge coupler 12 is formed in, for example, a so-called "ridge shape" that is a truncated square pyramid shape, and angles formed between a side surface c (see FIG. 2(*b*)) on a side of the high frequency substrate 20 and a bottom surface and a top surface are, respectively, right angles.

As shown in FIG. 2(*a*), the ridge coupler 12 is formed in a rectangular shape in a plan view and is arranged at a center position in a width direction that is perpendicular to a propagation direction of electromagnetic waves in the waveguide 10. In addition, the ridge coupler 12 is arranged so that a longitudinal direction of the rectangular shape is parallel to the propagation direction of electromagnetic waves.

The bottom surface of the ridge coupler 12 is arranged in contact with the first surface 11*a* of the waveguide 10 (see FIG. 2(*b*)). In addition, one end of the wire 30 is connected to one end of the ridge coupler 12 on the side of the high frequency substrate 20 on a top surface of the ridge coupler 12.

The waveguide wall 11 of the waveguide 10 and the ridge coupler 12 are formed of a conductor such as metal.

By forming the ridge coupler 12 configured as described above at one end inside the waveguide 10, mode conversion of electromagnetic waves that propagate through the waveguide 10 and the high frequency circuit 21 formed on the high frequency substrate 20 can be performed.

The high frequency substrate 20 has a transmission line 23, a grounding conductor 24 (see FIG. 2(*a*)), a grounding post 25, and the like, in which case these components constitute the high frequency circuit 21.

More specifically, the transmission line 23, the grounding conductor 24 formed so as to sandwich the transmission line 23, and the grounding post 25 provided at an end of the grounding conductor 24 on a side of the waveguide 10 are arranged on the high frequency substrate 20. Alternatively, the grounding post 25 may be formed in contact with the second surface 11*b* of the waveguide 10 as shown in FIG. 2(*b*).

As shown in FIGS. 2(*b*) and 3, the high frequency substrate 20 is arranged at a height that is equal to a height of the top surface of the ridge coupler 12. More specifically, the high frequency substrate 20 on which the high frequency circuit 21 is formed is mounted to a base 22 which is formed in an E-plane of the waveguide 10.

As shown in FIGS. 2(*b*) and 3, the base 22 has a side surface 22*a* which is parallel to the side surface c (see FIG. 2(*b*)) of the ridge coupler 12 and a mounting surface 22*b* to which the high frequency substrate 20 is to be mounted.

As shown in FIGS. 2(*b*) and 3, the mounting surface 22*b* is provided so as to oppose the second surface 11*b* of the waveguide wall 11 and is connected at an approximately right angle to the side surface 22*a*. It should be noted that the base 22 is formed continuously with the first surface 11*a* of the waveguide wall 11.

As shown in FIGS. 2(*a*), 2(*b*) and 3, the wire 30 connects one end of the ridge coupler 12 which is formed inside the waveguide 10 and the transmission line 23 of the high frequency circuit 21 with each other. The wire 30 causes electromagnetic waves subjected to wave conversion by the ridge coupler 12 to propagate to the transmission line 23 of the high frequency circuit 21. The wire 30 is formed of a metal material such as gold (Au).

As shown in FIGS. 2(*a*), 2(*b*), and 3, the metal block 40 is provided between the ridge coupler 12 and the transmission line 23. The metal block 40 is a grounding post which is formed in a rectangular parallelepiped and which has a prescribed height H_ADJ as shown in FIG. 2(*b*). The metal block 40 is respectively in contact with the side surface c of the ridge coupler 12, the side surface 22*a* of the base 22, and the first surface 11*a* which is the inner wall of the waveguide wall 11 (see FIG. 2(*b*)).

As shown in FIG. 2(*a*), the metal block 40 may be formed so that a width of the waveguide 10 in a direction perpendicular to the propagation direction of the electromagnetic waves in a plan view matches a width of the ridge coupler 12.

As shown in FIGS. 2(*b*), the metal block 40 is formed so that the height H_ADJ (see FIG. 2(*b*)) of the waveguide 10 in a direction perpendicular to the propagation direction of the electromagnetic waves is lower than a height from the first surface 11*a* of the waveguide wall 11 to the wire 30.

Providing the metal block 40 described above enables a ground inductance L which is formed between the ridge coupler 12 and the first surface 11*a* of the waveguide wall 11 to be reduced.

More specifically, as described in the conventional example (FIG. 10), the ground inductance L is present between the ridge coupler 12 and the first surface 11*a* of the waveguide 10 when the high frequency connection structure 1 in a case where the metal block 40 is not provided is viewed from a side of the high frequency circuit 21. However, by using the metal block 40 as in the present embodiment, inductances L1 and L2 (see FIG. 3) with the ground on a side surface of the waveguide 10 also becomes visible from the ridge coupler 12 via the metal block 40.

As shown in FIGS. 2(*b*) and 3, a length of the wire 30 in the propagation direction of electromagnetic waves is shorter than a height of the ridge coupler 12 in a direction perpendicular to the first surface 11*a* of the waveguide wall 11 (refer to PTL1). Therefore, since the inductances L1 and L2 (see FIG. 3) according to the present embodiment have smaller values than the ground inductance L (FIG. 10) described in the conventional example, the ground inductance L of the ridge coupler 12 as viewed from the side of the high frequency circuit 21 can be lowered.

Accordingly, phase rotation attributable to the ground inductance L which is created between the waveguide 10 and the ground is reduced and, as indicated by the arrow (i) in the Smith chart shown in FIG. 1, the locus can be rotated counter-clockwise and open/matching can be attained at $f_{IF}$.

Next, an effect of the high frequency connection structure 1 according to the present embodiment will be described with reference to FIGS. 4 and 5.

First, in the ridge coupler 12 designed to operate in the 300 GHz band, the height H_ADJ of the metal block 40 (see FIG. 2(*b*)) was changed from 100 μm to 300 μm. FIG. 4 shows a calculation result of a change in frequency that is open/matched at this point.

It should be noted that a length of the wire 30 is set to 100 μm and conductivity of the waveguide 10, the wire 30, and the metal block 40 is set to $2\times10^7$ S/m. In addition, with respect to designs of portions in common with the configuration described in the conventional example, designs similar to known high frequency connection structures were used (refer to PTL1).

Figure 4:
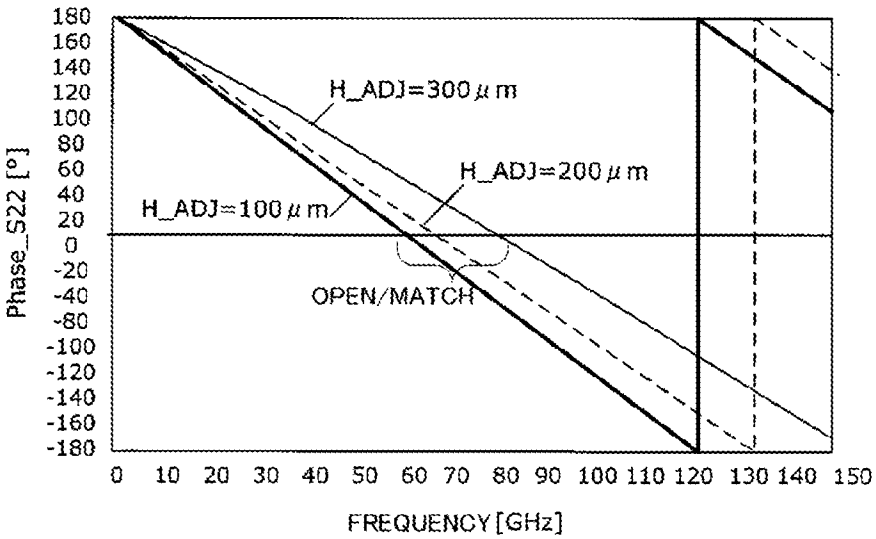
FIG. 4 is a diagram illustrating a phase of a reflection coefficient according to the first embodiment.

An abscissa in FIG. 4 represents frequency in GHz and an ordinate represents a phase (Phase_S22 in °) of a reflection coefficient in the ridge coupler 12 when viewed from a side of the high frequency circuit 21. In FIG. 4, a bold line indicates a phase when the height H_ADJ of the metal block 40 (see FIG. 2(*b*)) is 100 μm, a dashed line indicates a phase when the height H_ADJ (see FIG. 2(*b*)) is 200 μm, and a fine line indicates a phase when the height H_ADJ (see FIG. 2(*b*)) is 300 μm.

Figure 3:
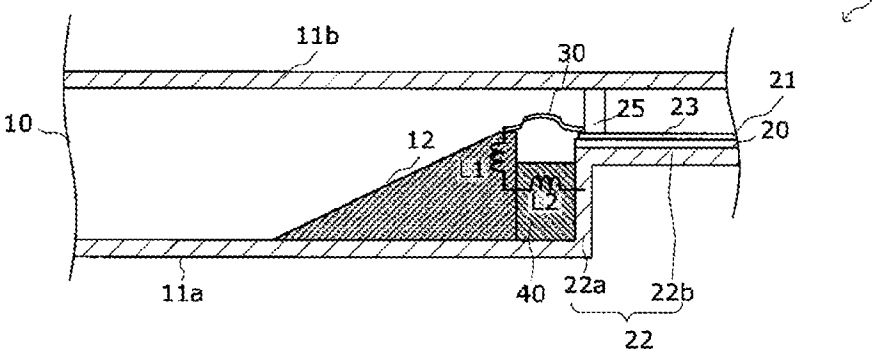
FIG. 3 is a diagram illustrating a metal block according to the first embodiment.

As is apparent from FIG. 4, as the height H_ADJ of the metal block 40 (see FIG. 2(*b*)) increases, the inductance L1 shown in FIG. 3 decreases. Therefore, the ground inductance L declines and phase rotation slows down. Accordingly, in FIG. 4, a variation corresponding to 20 GHz can be realized in a range from 60 GHz to 80 GHz with respect to a frequency at which open/match is attained.

Figure 5:
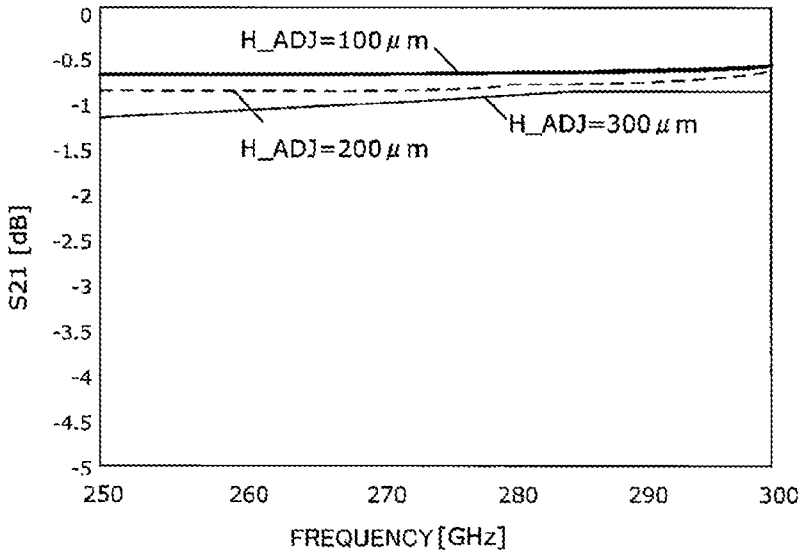
FIG. 5 is a diagram illustrating characteristics of the high frequency connection structure according to the first embodiment.

Next, FIG. 5 shows a calculation result of an effect of the metal block 40 on characteristics of the ridge coupler 12. An abscissa in FIG. 5 represents frequency in GHz and an ordinate represents transmission characteristics S21 in dB from the ridge coupler 12 to the transmission line 23 or, in other words, coupling characteristic of the coupler.

In addition, in FIG. 5, the height H_ADJ (100 μm, 200 μm, 300 μm) of the metal block 40 (see FIG. 2(*b*)) indicated by each line corresponds to FIG. 4. In FIG. 5, a bold line indicates a phase when the height H_ADJ of the metal block 40 (see FIG. 2(*b*)) is 100 μm, a dashed line indicates a phase when the height H_ADJ (see FIG. 2(*b*)) is 200 μm, and a fine line indicates a phase when the height H_ADJ (see FIG. 2(*b*)) is 300 μm. As shown in FIG. 5, it is found that a change in the height H_ADJ of the metal block 40 (see FIG. 2(*b*)) hardly affects the coupling characteristic of the coupler.

Figure 11:
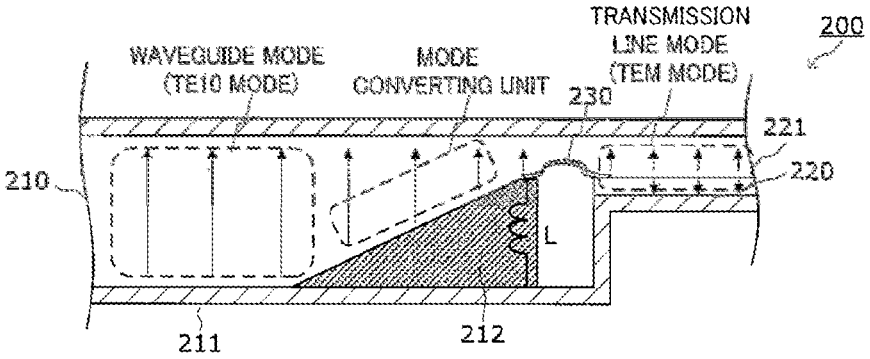
FIG. 11 is a diagram illustrating an example of an electric field distribution within an operating band of the conventional high frequency connection structure.
Figure 12:
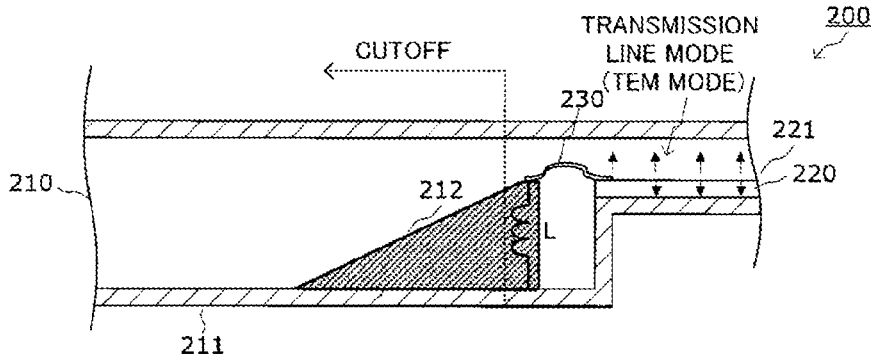
FIG. 12 is a diagram illustrating an example of an electric field distribution outside an operating band of the conventional high frequency connection structure.
Figure 13:
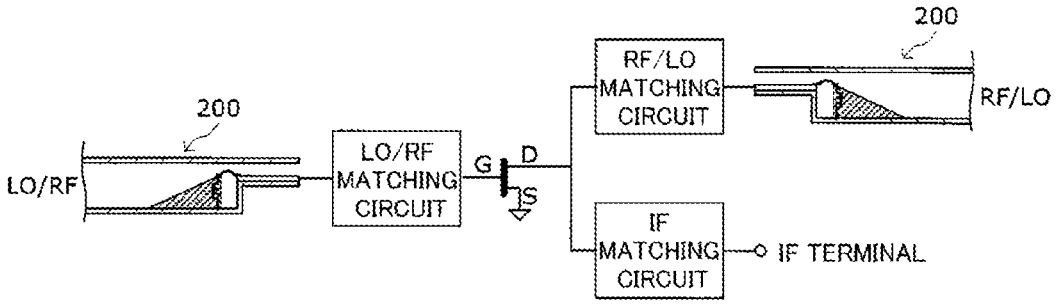
FIG. 13 is a diagram illustrating an example of applying the conventional high frequency connection structure to a mixer.

In this case, as described in the conventional example (FIG. 11), a signal in the 300 GHz band which is transmitted through the portion of the wire 30 is converted into a microstrip mode which adopts the wire 30 as a signal line and the second surface 11*b* that is a wall surface of the upper part of the waveguide 10 as ground. Therefore, as shown in FIG. 3, even when the metal block 40 is installed between the ridge coupler 12 and the high frequency circuit 21 (the transmission line 23), the metal block 40 hardly contributes to the coupling characteristic of the coupler.

However, as described earlier, an upper limit value of the height H_ADJ of the metal block 40 (see FIG. 2(*b*)) must be set to a height from the first surface 11*a* of the waveguide 10 to the wire 30. This is because, if the metal block 40 comes into contact with the wire 30, a signal in the 300 GHz band is also grounded and the coupling characteristic of the coupler deteriorates significantly.

As described above, according to the first embodiment, since the high frequency connection structure 1 includes the metal block 40 between the ridge coupler 12 and the high frequency circuit 21, an amount of phase that has excessively rotated due to the ground inductance L of the ridge coupler 12 can be reduced.

Therefore, when applying the ridge coupler 12 to the high frequency circuit 21 that handles signals outside an operating band of the waveguide 10 or the ridge coupler 12, characteristic degradation of the high frequency circuit 21 due to the ground inductance L of the ridge coupler 12 can be suppressed.

In addition, for example, when attempting to realize phase reduction by adjusting the ground inductance L of the ridge coupler 12 from a side of the high frequency circuit 21, a circuit is necessary which is constituted by a metamaterial or the like that causes phase to be restored with respect to an increase in frequency. In this case, design of the high frequency connection structure 1 becomes complex and design cost also increases.

By comparison, since the high frequency connection structure 1 according to the present embodiment enables characteristic degradation of the high frequency circuit 21 to be suppressed by changing only a configuration around the ridge coupler 12, design cost of high frequency components can be significantly reduced.

Second Embodiment

Next, a second embodiment of the present invention will be described. In the following description, same components as those of the first embodiment described above will be denoted by same reference characters and redundant descriptions will be omitted.

In the first embodiment, a case where an adjustment to reduce the ground inductance L of the ridge coupler 12 is performed using the metal block 40 has been described. In contrast, in the second embodiment, a depressed portion 50 or, in other words, a depression is formed on the first surface 11*a* of the waveguide 10 on a side of the bottom surface of the ridge coupler 12. According to such a configuration, a locus is rotated in the clockwise direction indicated by the arrow (ii) in the Smith chart in FIG. 1 to make an adjustment to increase the ground inductance L.

Figures 6A, 6B:
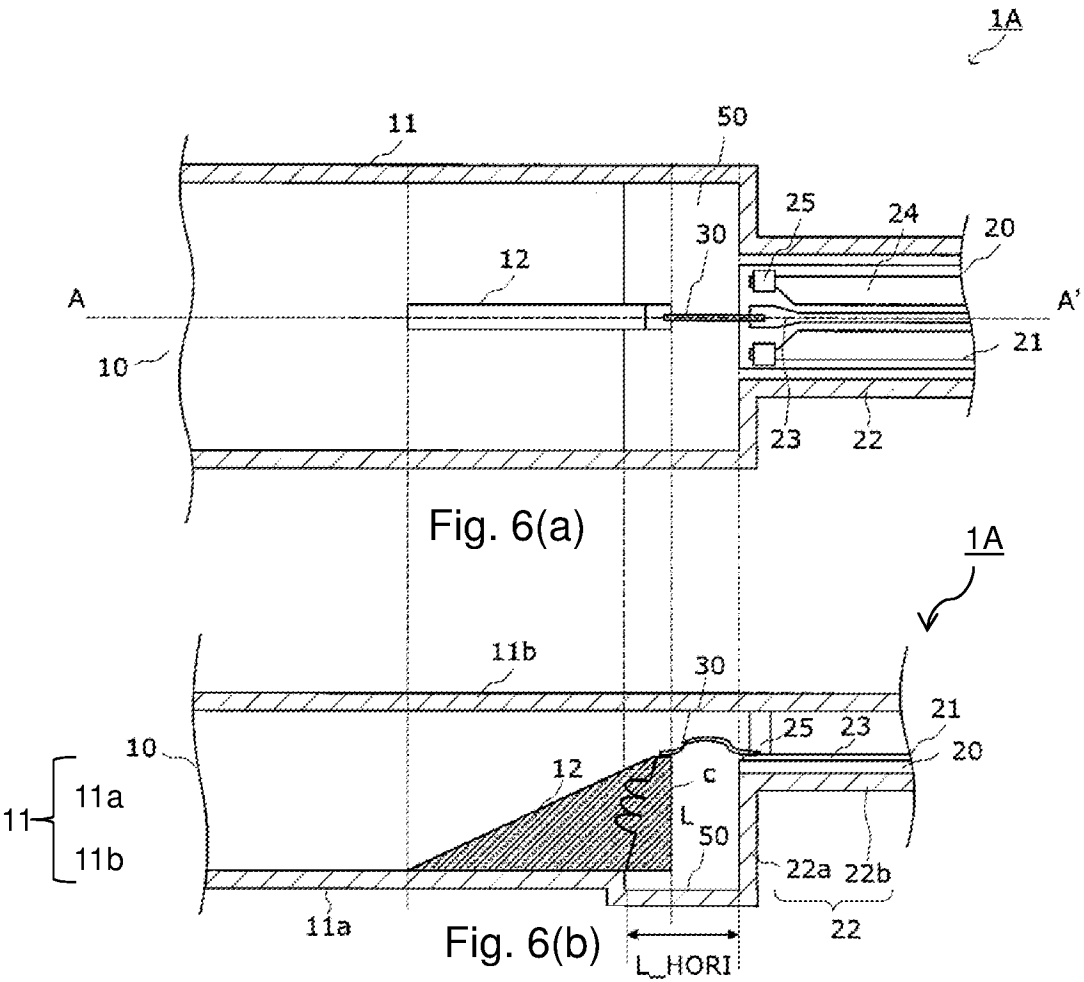
FIGS. 6(*a*) and 6(*b*) are schematic views of a high frequency connection structure according to a second embodiment.

FIG. 6(*a*) is a schematic plan view of a high frequency connection structure 1A according to the second embodiment. FIG. 6(*b*) is a sectional view taken along line A-A' in FIG. 6(*a*).

The depressed portion 50 is formed on the first surface 11*a* (see FIG. 6(*b*)) which is an inner wall of the waveguide 10 on a side of the bottom surface of the ridge coupler 12 from an end on a side of the side surface c (see FIG. 6(*b*)) of the ridge coupler 12 to the side surface 22*a* of the base 22 (see FIG. 6(*b*)). The depressed portion 50 has a prescribed length L_HORI (see FIG. 6(*b*)) and a prescribed depth.

The length L_HORI of the depressed portion 50 (see FIG. 6(*b*)) in a propagation direction of electromagnetic waves in the waveguide 10 is formed so as to be longer than a distance from the side surface c of the ridge coupler 12 to the side surface 22*a* of the base 22.

Due to the formation of the depressed portion 50 on the first surface 11*a*, as shown in FIG. 6(*b*), a portion that is not in contact with the first surface 11*a* of the waveguide wall 11 is formed in a part of a bottom portion of the ridge coupler 12. It should be noted that, in the present embodiment, the depressed portion 50 is formed across the width of the waveguide 10 in a direction perpendicular to the propagation direction of the electromagnetic waves in a plan view shown in FIG. 6(*a*).

In addition, the depth of the depressed portion 50 is set so that a sufficient space is formed on a side of a bottom surface end of the ridge coupler 12. For example, when the depressed portion 50 is too shallow, capacitive coupling may occur between the ridge coupler 12 and a conductor of the first surface 11*a* in a portion where the depressed portion 50 is formed. On the other hand, when the depressed portion 50 is too deep, a space formed by the depressed portion 50 may cause signals to resonate. The depth of the depressed portion 50 may be set to a suitable value in consideration of the above.

Due to the formation of the depressed portion 50 described above, as shown in FIG. 6(*b*), a shortest path to ground in the ridge coupler 12 is expanded and the ground inductance L of the ridge coupler 12 as viewed from the side of the high frequency circuit 21 can be increased.

Therefore, a phase amount attributable to the ground inductance L which is created in the waveguide 10 with ground can be increased and, as indicated by the arrow (ii) in the Smith chart shown in FIG. 1, the locus can be rotated clockwise and open/matching can be attained at $f_{IF}$.

Next, an effect of the high frequency connection structure 1A according to the present embodiment will be described with reference to FIGS. 7 and 8.

First, in the ridge coupler 12 designed to operate in the 300 GHz band, the length L_HORI of the depressed portion 50 (see FIG. 6(*b*)) in the propagation direction of electromagnetic waves was changed from 400 μm to 600 μm. FIG. 7 shows a calculation result of a change in frequency that is open/matched at this point.

It should be noted that the high frequency connection structure 1A was designed by adopting similar values to those used in the calculation in FIG. 4 (refer to PTL1).

Figure 7:
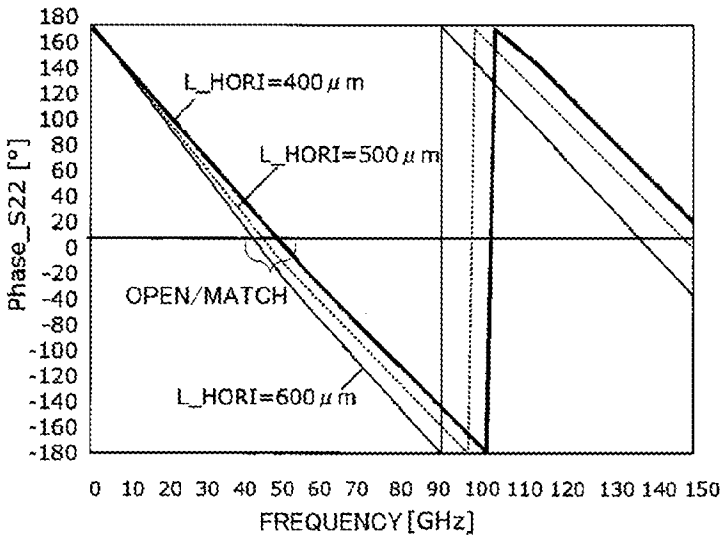
FIG. 7 is a diagram illustrating a phase of a reflection coefficient according to the second embodiment.

An abscissa in FIG. 7 represents frequency in GHz and an ordinate represents a phase (Phase_S22 in °)) of a reflection coefficient in the ridge coupler 12 when viewed from a side of the high frequency circuit 21. In FIG. 7, a bold line indicates a phase when the length L_HORI of the depressed portion 50 (see FIG. 6(*b*)) is 400 μm, a dotted line indicates a phase when the length L_HORI (see FIG. 6(*b*)) is 500 μm, and a fine line indicates a phase when the length L_HORI (see FIG. 6(*b*)) is 600 μm.

As is apparent from FIG. 7, a frequency band to be open/matched can be adjusted to a further low frequency-side by increasing the length L_HORI of the depressed portion 50.

Figure 8:
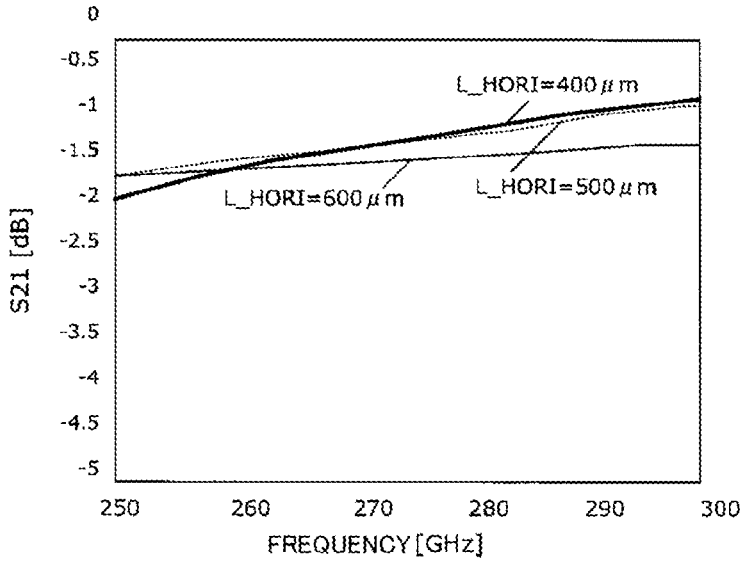
FIG. 8 is a diagram illustrating characteristics of the high frequency connection structure according to the second embodiment.
Figure 9A:
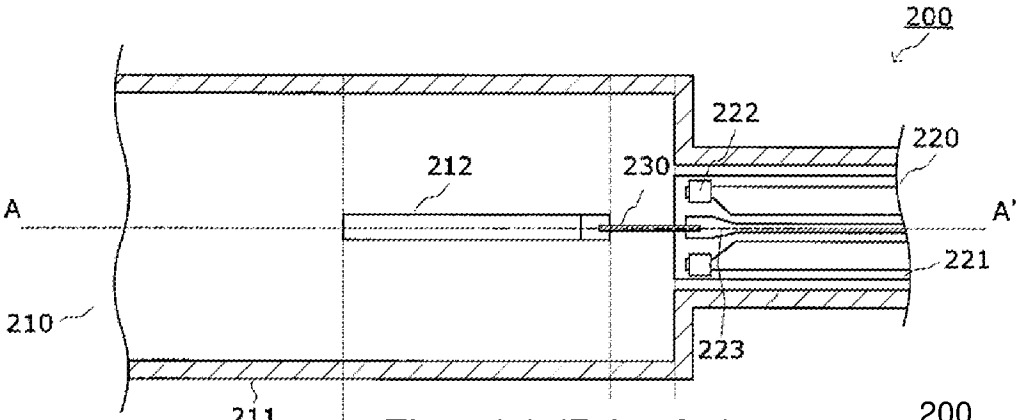
Fig. 9(a) (Prior Art)
FIGS. 9(*a*) and 9(*b*) are schematic views showing an example of a conventional high frequency connection structure.
Figure 9B:
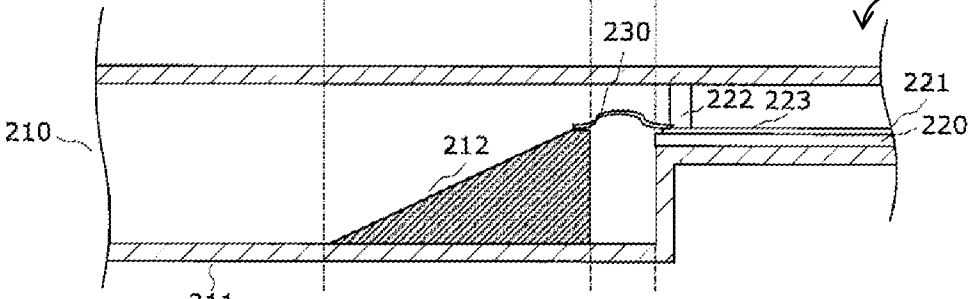
Fig. 9(b) (Prior Art)

Next, FIG. 8 shows a result of a calculation of an effect of the depressed portion 50 on characteristics of a ridge coupler in the 300 GHz band which is constituted by the ridge coupler 12. An abscissa in FIG. 8 represents frequency in GHz and an ordinate represents transmission characteristics S21 in dB from the ridge coupler 12 to the transmission line 23 or, in other words, coupling characteristic of the coupler.

In addition, in FIG. 8, the length L_HORI (400 μm, 500 μm, 600 μm) of the depressed portion 50 (see FIG. 6(*b*)) indicated by each line corresponds to FIG. 7. In FIG. 8, a bold line indicates a phase when the length L_HORI of the depressed portion 50 (see FIG. 6(*b*)) is 400 μm, a dotted line indicates a phase when the length L_HORI (see FIG. 6(*b*)) is 500 μm, and a fine line indicates a phase when the length L_HORI (see FIG. 6(*b*)) is 600 μm. As is apparent from FIG. 8, it is shown that a change in the length L_HORI of the depressed portion 50 (see FIG. 6(*b*)) does not particularly affect the coupling characteristic of the coupler.

Furthermore, compared to the coupling characteristic of the coupler in the case of using the metal block 40 as shown in FIG. 5, with the high frequency connection structure 1A provided with the depressed portion 50 according to the present embodiment, it is shown that loss increases by around 1 dB but is nevertheless kept to or below 2 dB and favorable coupling characteristic of the coupler are obtained.

As described above, according to the second embodiment, since the high frequency connection structure 1A has the depressed portion 50 formed on the first surface 11*a* (see FIG. 6(*b*)) on a side of the bottom surface of the ridge coupler 12 from an end of the ridge coupler 12 on a side of the high frequency circuit 21 to the side surface 22*a* of the base 22, the ground inductance L of the ridge coupler 12 increases and an amount of phase can be increased.

Therefore, degradation in characteristics of the high frequency circuit 21 due to the ground inductance L that occurs in the ridge coupler 12 occur less likely in the high frequency connection structure 1A when the ridge coupler 12 is applied to the high frequency circuit 21 that handles signals outside an operating band of the waveguide 10 or the ridge coupler 12.

When attempting to realize such a phase increase by adjusting the ground inductance L of the ridge coupler 12 from a side of the high frequency circuit 21, a transmission line needs to be additionally inserted on the side of the high frequency circuit 21. However, in an ultrahigh frequency band such as 300 GHz, since propagation loss of a line is extremely large, such an extra transmission line has a direct bearing on degradation of circuit characteristics.

In addition, since compensating for propagation loss of a line due to an additionally inserted transmission line requires an amplifier or the like that has a gain corresponding to a loss due to such an extra transmission line, design of the high frequency connection structure becomes complicated and design cost increases.

By comparison, since the high frequency connection structure 1A according to the present embodiment enables characteristic degradation of the high frequency circuit 21 to be suppressed by changing only a configuration of a peripheral portion of the ridge coupler 12, design cost of high frequency components can be significantly reduced.

Although embodiments of the high frequency connection structure according to the present invention have been described above, it is to be understood that the present invention is not limited to the described embodiments and that various modifications will occur to and can be made by those skilled in the art without departing from the spirit and the scope of the invention as defined in the appended claims.

REFERENCE SIGNS LIST

1, 1A High frequency connection structure
10 Waveguide
11 Waveguide wall
11*a* First surface
11*b* Second surface
12 Ridge coupler
20 High frequency substrate
21 High frequency circuit
22 Base
22*a* Side surface
22*b* Mounting surface
23 Transmission line
24 Grounding conductor
25 Grounding post
30 Wire
40 Metallic block
50 Depressed portion.

The invention claimed is:

1. A structure, comprising:

a base;

a waveguide;

a conductor inside the waveguide;

a transmission line;

an inductance adjustment structure between the conductor and the transmission line, wherein the inductance adjustment structure adjusts a ground inductance resulting from a connection between the conductor and the waveguide, wherein the inductance adjustment structure includes a metal block that is a rectangular parallelepiped and is in contact with a side surface of the conductor, a side surface of the base, and an inner wall of the waveguide; and a wire connecting the conductor to the transmission line.

2. The structure according to claim 1, wherein the wire connects a top surface of the conductor to the transmission line.

3. The structure according to claim 1, wherein a height of the metal block in a direction perpendicular to a propagation direction of electromagnetic waves in the waveguide is less than a distance from the inner wall of the waveguide to the wire.

4. The structure according to claim 1, wherein the conductor has a truncated rectangular pyramid shape, wherein a first right angle is formed between the side surface of the conductor and a bottom surface of the conductor, wherein a second right angle is formed between the side surface of the conductor and a top surface of the conductor, wherein the side surface of the conductor faces the transmission line.

5. The structure according to claim 4, wherein:

the side surface of the base is parallel to the side surface of the conductor, and wherein the transmission line is disposed on an integrated circuit board supported by the base.

6. The structure according to claim 5, wherein the bottom surface of the conductor is in contact with the inner wall of the waveguide.

7. A high frequency connection structure, comprising:

a base a waveguide;

a ridge structure comprising a conductor inside a first end of the waveguide;

a transmission line adjacent to the first end of the waveguide;

an inductance adjustment structure between the ridge structure and the transmission line, wherein the inductance adjustment structure adjusts a ground inductance resulting from a connection between the ridge structure and the waveguide, wherein the inductance adjustment structure includes a metal block that is a rectangular parallelepiped and is in contact with a side surface of the ridge structure, a side surface of the base, and an inner wall of the waveguide; and a wire connecting a first end of the ridge structure on a side of the transmission line and a first end of the transmission line.

8. The high frequency connection structure according to claim 7, wherein:

the side surface of the base is parallel to the side surface of the ridge structure on a side of the transmission line, wherein the ridge structure has a truncated rectangular pyramid shape, wherein a first right angle is formed between the side surface of the ridge structure and a bottom surface of the ridge structure, wherein a second right angle is formed between the side surface of the ridge structure and a top surface of the ridge structure, wherein the bottom surface of the ridge structure is in contact with the inner wall of the waveguide, wherein the transmission line is disposed on an integrated circuit board supported by the base, and wherein the wire connects the top surface of the first end of the ridge structure to the first end of the transmission line.

9. The high frequency connection structure according to claim 7, wherein a height of the metal block in a direction perpendicular to a propagation direction of electromagnetic waves in the waveguide is less than a distance from the inner wall of the waveguide to the wire.

10. A high frequency connection structure, comprising:

a base;

a waveguide;

a ridge structure comprising a conductor inside a first end of the waveguide;

a transmission line adjacent to the first end of the waveguide;

an inductance adjustment structure between the ridge structure and the transmission line, wherein the inductance adjustment structure adjusts a ground inductance resulting from a connection between the ridge structure and the waveguide, wherein the inductance adjustment structure is a depressed portion on an inner wall of the waveguide, wherein the depressed portion is on a side of a bottom surface of the ridge structure and extends from a side surface of the ridge structure to a side surface of the base; and a wire connecting a first end of the ridge structure on a side of the transmission line and a first end of the transmission line.

11. The high frequency connection structure according to claim 10, wherein the ridge structure overlaps a sidewall of the depressed portion.

12. The high frequency connection structure according to claim 10, wherein a length of the depressed portion measured in a propagation direction of electromagnetic waves in the waveguide is longer than a distance between the side surface of the ridge structure and the side surface of the base.

13. The high frequency connection structure according to claim 10, wherein:

the side surface of the base is parallel to the side surface of the ridge structure on a side of the transmission line, wherein the ridge structure has a truncated rectangular pyramid shape, wherein a first right angle is formed between the side surface of the ridge structure and the bottom surface of the ridge structure, wherein a second right angle is formed between the side surface of the ridge structure and a top surface of the ridge structure, wherein the bottom surface of the ridge structure is in contact with the inner wall of the waveguide, wherein the transmission line is disposed on an integrated circuit board supported by the base, and wherein the wire connects the top surface of the first end of the ridge structure to the first end of the transmission line.

* * * * *